US006581792B1

(12) United States Patent
Limanjaya

(10) Patent No.: US 6,581,792 B1
(45) Date of Patent: Jun. 24, 2003

(54) CLOSURE CAP

(76) Inventor: Tjandra Limanjaya, J1. Kaji 1 B - BA, Petojo Utara, Jakarta Pusat 10/30 (ID)

( * ) Notice: Subject to any disclaimer, the term of this patent is extended or adjusted under 35 U.S.C. 154(b) by 0 days.

(21) Appl. No.: 09/857,476

(22) PCT Filed: Dec. 7, 1999

(86) PCT No.: PCT/IB99/01954

§ 371 (c)(1),
(2), (4) Date: Apr. 10, 2002

(87) PCT Pub. No.: WO00/34133

PCT Pub. Date: Jun. 15, 2000

Related U.S. Application Data

(63) Continuation of application No. 09/396,511, filed on Sep. 15, 1999, now abandoned.

(30) Foreign Application Priority Data

Dec. 7, 1998 (TW) ..... 87220383 U

(51) Int. Cl.[7] ..... B65D 39/00
(52) U.S. Cl. ..... 215/252; 215/344
(58) Field of Search ..... 215/252, 344

(56) References Cited

U.S. PATENT DOCUMENTS

| | | | |
|---|---|---|---|
| 3,069,040 | A | 12/1962 | Corsette |
| 3,632,005 | A | 1/1972 | Kessler |
| 5,450,973 | A | 9/1995 | Ellis et al. |

FOREIGN PATENT DOCUMENTS

| | | |
|---|---|---|
| DE | 2614335 | 10/1976 |
| DE | 4108453 | 10/1991 |
| EP | 0076778 | 4/1983 |
| EP | 0508668 | 10/1992 |
| EP | 0683106 | 11/1995 |
| EP | 90016 | 1/1997 |
| GB | 2022063 | 12/1979 |
| JP | 62-102061 | 5/1987 |
| JP | 62-223573 | 10/1987 |
| JP | 6-213521 | 8/1994 |
| JP | 8183547 | 7/1996 |
| JP | 8-318731 | 12/1996 |
| WO | 8707584 | 12/1987 |
| WO | 9826991 | 6/1998 |

*Primary Examiner*—Stephen K. Cronin
(74) *Attorney, Agent, or Firm*—Ware, Fressola, Van Der Sluys & Adolphson LLP

(57) ABSTRACT

An injection moulded, plastics material cap (1) for a screw top bottle has a top and a skirt with an anti-tamper band (2) connected to the skirt at a tear-off line by links (3). On the inside of the top of the cap, a depending annular ridge (10) is provided. Its inside diameter is such that it abuts and seals on the outside diameter of the distal end of the neck of the bottle. Also on the inside of the cap, inside the ridge (10), is moulded a forked feature having an inner limb (12) which extends generally downwards with an outwards bias, and an outer limb (13) which extends generally outwards with downwards bias. The inner limb is dimensioned to fit inside the mouth at the neck of the bottle, sealingly engaging it, whiles the outer limb is dimensioned to abut the end of the neck, also sealingly engaging it when the cap is screwed tight.

13 Claims, 4 Drawing Sheets

CLOSURE CAP

This application is a 371 of PCT/IB99/01954 filed Dec. 7, 1999 which is a continuation of Ser No. 09/396,511 filed Sep. 15, 1999 abandoned.

BACKGROUND OF THE INVENTION

1. Field of the Invention

The present invention relates to a plastics material cap for closing a container and in particular, but not exclusively a closure cap for a screw top bottle.

2. Description of the Prior Art

Conventional plastics material caps for screw top bottles have liners inside the top of the cap to act as seals. When the cap is screwed onto the neck of the bottle, the top of the neck compresses the liner, which seals the bottle. However manufacturing caps with liners of a different material is time consuming and expensive in labour and material. Further, recycling is difficult because of the use of two different types of material. Also in order to obtain a reliable seal, use of the correct material for the liner and adequate attachment of the liner to the cap are crucial for effective sealing.

Recently, improvements have been introduced. In place of the liner, a ring extending down from the inside of the top of the cap can be used. When the cap is screwed onto the bottle, the ring and the top of the neck tightly abut, sealing the bottle. However, the material of the cap cannot be as flexible as that of a liner, therefore the precision of the moulding of the cap is critical. Further, the force with which the cap is applied, that is to say the torque applied by a capping machine or capper, needs to be higher than is the case with a liner in the cap. Increasing the torque can itself introduce unreliability.

European patent application No. 0508668 describes a plastics material cap for closing a container, the cap comprising:

a top and a skirt;

first annular sealing member arranged to abut the inside of a neck of the container and a second annular sealing member arranged to abut the distal end of the neck of the container, the first and second members have a common root, whereby abutment of the distal end of the container with second member tends to rotate the first member into firmer contact with the inside of the neck, and a third annular sealing member arranged to abut the outside of the neck of the container and means on the skirt for holding the cap in sealing relationship with the container.

Another conventional feature is the inclusion of an anti-tamper band at the bottom of the skirt of the cap. This is connected to the cap by frangible links extending from the skirt to the band. Where, as is conventional, the anti-tamper band includes a continuous internal ridge, which rides over and engages under a complementary ridge on the bottle, a considerable amount of force and torque must be transmitted by the links to the band. For this the links must be of a certain size. However, making the links large enough to force the ridges over each other can make them too strong to enable easy breaking of the anti-tamper band from the skirt on opening of the bottle.

International patent application No. WO 98/26991 A describes a plastics material cap for closing a container, the cap comprising:

a top and a skirt;

means integrally formed with the top on its inside for sealing the cap to the container;

means on the skirt for holding the cap in sealing relationship with the container; and an anti-tamper band frangibly connected to the skirt, the band having a plurality of upwardly directed tongues resiliently mounted on the band for engagement under a rim on the container on fitting of the cap to the container.

OBJECT OF THE INVENTION

The object of the invention is to provide an improved closure cap.

SUMMARY OF THE INVENTION

According to a first aspect of the invention there is provided a plastics material cap for closing a container, the cap comprising:

a top and a skirt;

a first annular sealing member arranged to abut the inside of a neck of the container and a second annular sealing member arranged to abut the distal end of the neck of the container, the first and second members have a common root, whereby abutment of the distal end of the container with second member tends to rotate the first member into firmer contact with the inside of the neck, and a third annular sealing member arranged to abut the outside of the neck of the container and means on the skirt for holding the cap in sealing relationship with the container;

wherein:

the three annular sealing members depend from the top of the cap;

wherein:

the three annular sealing members are lips dimensioned for slight deflection on sealing abutment with container and adapted to deflect against the bottle under pressure of fluid to be sealed, the first sealing lip extending transversely of the top of the cap from the common root, the second sealing lip extending obliquely towards the skirt of the cap from the common root and the third sealing lip extending transversely of the top of the cap;

wherein:

the sealing lips are of substantially the same cross-sectional shape, being in cross-section:

substantially uniform thickness lips, with rounded sealing edges.

Whilst it can be envisaged that the means for holding the cap in position can be a snap fit of a feature on the skirt onto a feature on the neck, preferably the means for holding the cap in its sealing position is a screw thread in the cap for co-operation with a screw thread on the bottle.

Normally, the skirt will be provided with an anti-tamper band.

According to another aspect of the invention there is provided a plastics material cap for closing a container, the cap comprising:

a top and a skirt;

means integrally formed with the top on its inside for sealing the cap to the container;

means on the skirt for holding the cap in sealing relationship with the container; and an anti-tamper band frangibly connected to the skirt, the band having a plurality of upwardly directed tongues resiliently mounted on the band for engagement under a rim on the container on fitting of the cap to the container wherein there are also provided invert V fold members between and interconnecting the tongues;

ribs on the radially outer surfaces of the tongues for limiting the radial movement of tongues on fitting of the cap to the container; and a ridge on the inside surface of the skirt for co-operating with the ribs in limiting radial movement of the tongues.

Preferably the cap holding means is a screw thread in the skirt for threadedly engaging a complementary thread on the container.

Preferably the sealing means is means integrally formed with the top on its inside for sealing the cap to the container, the sealing means being in accordance with the first aspect of the invention.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENT

Figure 1:
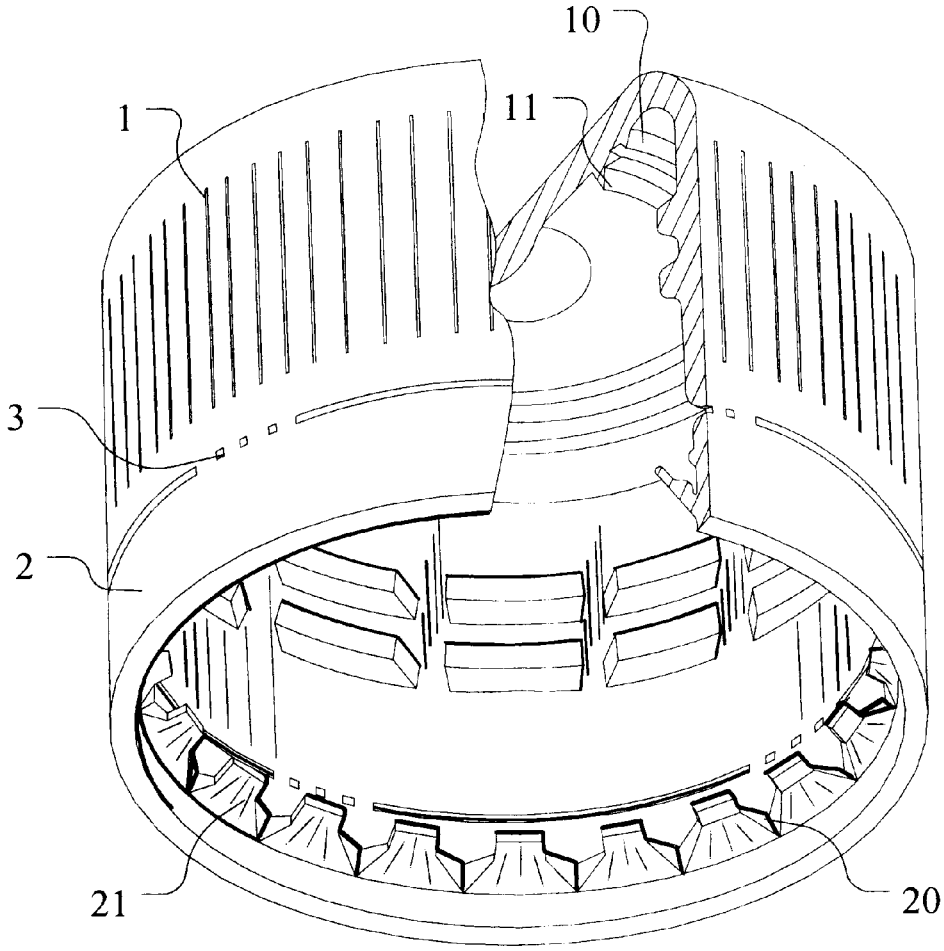
FIG. 1 is a partially broken away perspective view from below off a closure cap of the invention.
Figure 2:
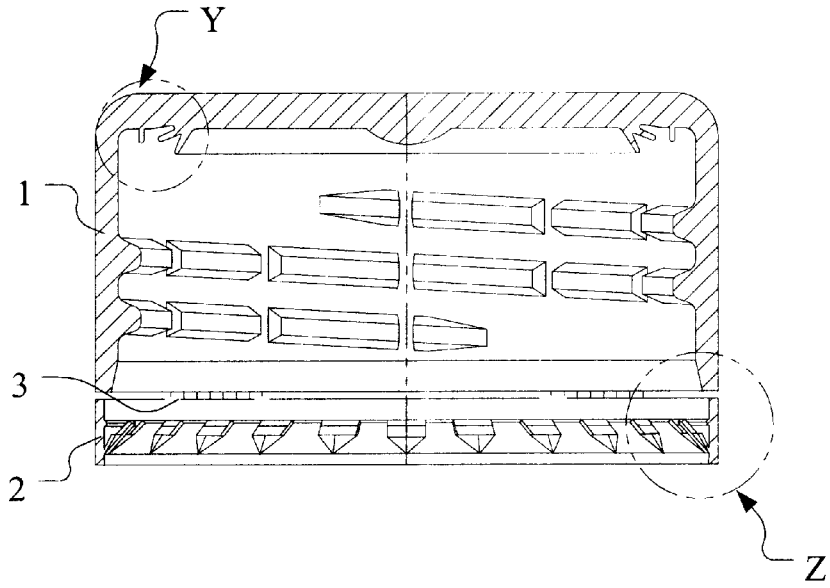
FIG. 2 is a central cross-sectional side view of the cap of FIG. 1.
Figure 2A:
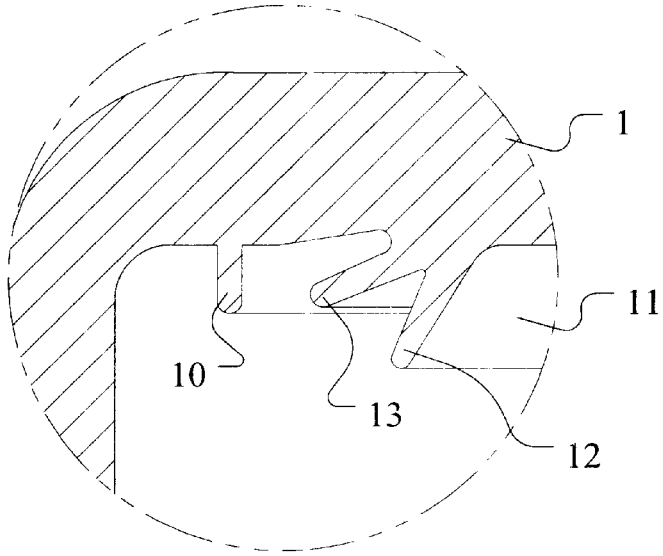
FIG. 2A is a scrap view on a larger scale of the sealing detail at Y in FIG. 2.
Figure 2B:
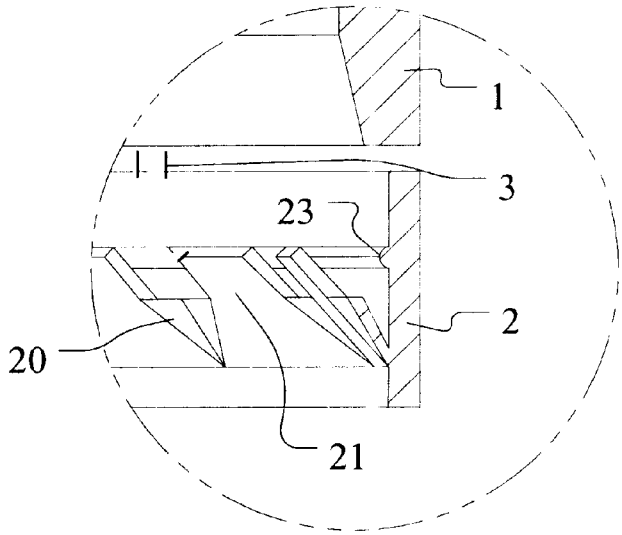
FIG. 2B is a scrap view on a larger scale of the anti-tamper detail at Y in FIG. 2.
Figure 3:
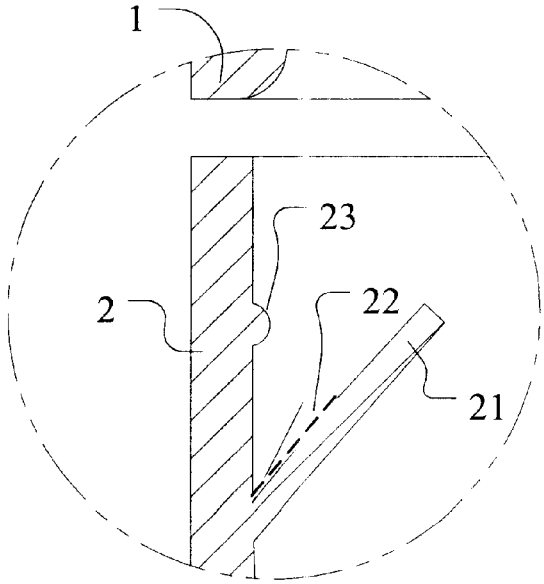
FIG. 3 is a cross-sectional view on the same scale as FIG. 2B through an anti-tamper tongue.

Referring to the drawings, the injection moulded, plastics material cap 1 there-shown for a screw top bottle has a top and a skirt with an anti-tamper band 2 connected to the skirt at a tear-off line by links 3.

Figure 4:
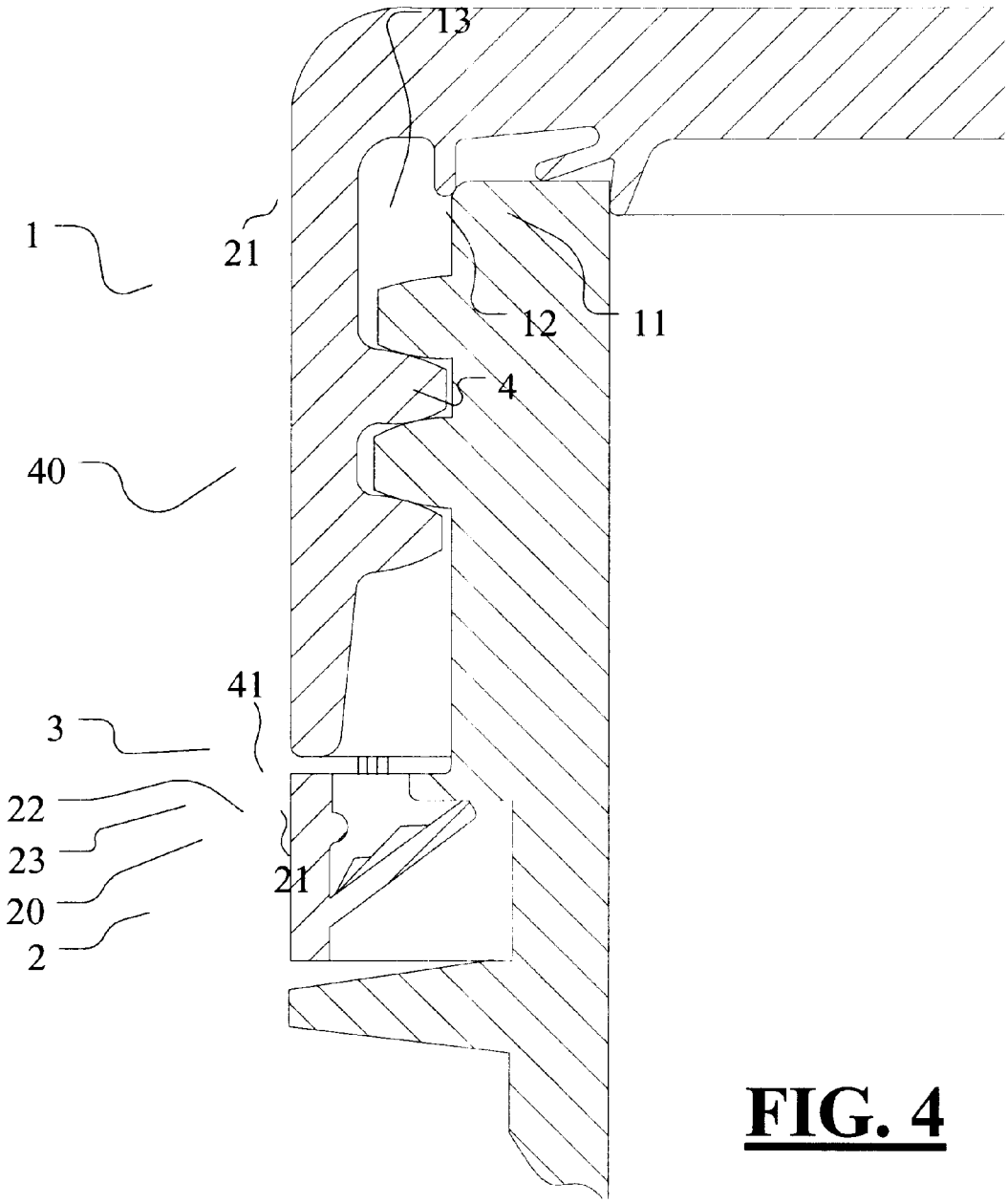
FIG. 4 is a cross-sectional view through the cap when fitted to a bottle.

On the inside of the top of the cap, a depending annular ridge 10 is provided. Its inside diameter is such that it abuts and seals on the outside diameter of the distal end of neck of the bottle, as shown in FIG. 4. Also on the inside of the cap, inside the ridge 10, another annular feature is moulded, with a forked cross-section. This has an inner—that is smaller diameter—limb 12 which extends generally downwards with an outwards bias, and an outer limb 13 which extends generally outwards with downwards bias. The inner limb is dimensioned to fit inside the mouth at the neck of the bottle, sealingly engaging it, whilst the outer limb is dimensioned to abut the end of the neck, also sealingly engaging it when the cap is screwed tight.

On the inside of the anti-tamper band, upwardly and inwardly extending tongues 21 are provided. Adjacent ones of these are interconnected by webs 20 in the form of invert V folds. The folds extend up and out (radially) from the tongues. The latter have ribs 22 on their outer faces Above the proximal ends of the tongues, a ridge 23 is provided around the inside of the band, at a position such that the ribs abut it when the tongues are pushed up, as on screwing of the cap onto the bottle. The combined action of the folded webs 20 and the resilience of the tongues 21 themselves causes them to spring inwards when pushed outwards during fitting of the cap to the bottle as described below. The abutment of the ribs 22 against the ridge 23 limits the outwards movement of the tongues.

The cap is moulded integrally with the cap as such connected to the anti-tamper band 2 by the links 3. On filling of a bottle, the cap is placed on the bottle's neck by a capping machine. Inside the skirt of the cap, that is above the band, the cap has screw formations complementary to the screw formations 40 on the neck of the bottle. Below these latter, the neck has an anti-tamper ridge 41.

The cap is screwed on and tightened by a capper. As the cap is screwed down, the tongues come into abutment with the ridge 41, which urges them outwards. When the distal ends of the tongues pass the ridge, they spring in underneath it. The arrangement of the tongues at an upwards angle and the folds between them enables the tongues to be deflected with a relatively low torque applied to the cap by the capper. At the same time, abutment of the ribs 22 against the ridge 23 avoids excessive deformation of the tongues for any reason. Thus when the tongues clear the ridge 41, they are not excessively stressed and readily spring back to engage beneath the ridge 41.

This occurs at the point at which the cap has sealed the bottle. The inner limb 12, which in effect forms a continuous lip, is received inside the mouth of the bottle and is in sealing abutment with it. The lip is squeezed in radially to a small extent, having a free diameter slightly greater than the internal diameter of the mouth. The outer limb or lip 13 abuts the distal end of the neck and is also deflected to a small extent, to bring it into sealing abutment with the neck. Since the lips have a common root of connection to the top of the cap, they tend to pivot together. Thus deflection of the outer lip towards the top of the cap tends to urge the inner lip into firmer contact with the inside of the mouth of the bottle. A third region of sealing abutment is between the ridge 10 and the outside edge of the bottle.

Where the bottle is used for hot-fill, that is to say the contents are filled when hot, a slight vacuum may develop in the bottle. In this circumstance, the outer lip 13 will have a greater pressure on its outside than its inside. This pressure differential tends to urge the lip 13 into sealing engagement with the end of the bottle. On the other hand, if the pressure in the bottle exceeds ambient pressure, as with carbonated drinks or still liquids in an aircraft hold, the inner lip will have a pressure differential across it urging into contact with the neck of the bottle. In either circumstance, the ridge 10 provides an additional seal with the neck of the bottle.

On opening of the bottle, the cap is unscrewed. The tongues engaged under the ridge 41 hold the anti-tamper band tightly on the bottle, so that only a small unscrewing movement of the cap is needed to rupture the links 3 at the tear off line. Thus any attempted tampering prior to purchase can be seen by inspection of the cap for separation of the band from the cap proper.

What is claimed is:

1. A plastics material cap for closing a container, the cap comprising:

top and a skirt;

a first annular sealing member arranged to abut the inside of a neck of the container and a second annular sealing member arranged to abut the distal end of the neck of the container, the first and second members have a common root, whereby abutment of the distal end of the container with second member tends to rotate the first member into firmer contact with the inside of the neck, and a third annular sealing member arranged to abut the outside of the neck of the container and means on the skirt for holding the cap in sealing relationship with the container, wherein:

the three annular sealing members depend from the top of the cap;

wherein:

the three annular sealing members are lips dimensioned for slight deflection on sealing abutment with the container and adapted to deflect against the bottle under pressure of fluid to be sealed, the first sealing lip extending transversely of the top of the cap from the common root, the second sealing lip extending obliquely towards the skirt of the cap from the common root and the third sealing lip extending transversely of the top of the cap;

wherein:

the sealing lips are of substantially the same cross-sectional shape, being in cross-section:
substantially uniform thickness lips, with
rounded sealing edges.

2. A plastics material cap as claimed in claim 1, wherein the skirt has an anti-tamper band.

3. A plastics material cap as claimed in claim 2, wherein the anti-tamper band comprises:

a plurality of upwardly directed tongues resiliently mounted on the band for engagement under a rim on the container on fitting of the cap to the container, invert V fold members between and interconnecting the tongues;

ribs on the radially outer surfaces of the tongues for limiting the radial movement of tongues on fitting of the cap to the container; and a ridge on the inside surface of the skirt for co-operating with the ribs in limiting radial movement of the tongues.

4. A plastics material cap as claimed in claim 1, wherein the means for holding the cap in position is a snap fitting of a feature on the skirt onto a feature on the neck.

5. A plastics material cap as claimed in claim 1 or claim 4, wherein the means for holding the cap in its sealing position is a screw thread in the cap for co-operation with a screw thread on the bottle.

6. A plastics material cap as claimed in claim 5, wherein the skirt has an anti-tamper band.

7. A plastics material cap as claimed in claim 6, wherein the anti-tamper band comprises:

a plurality of upwardly directed tongues resiliently mounted on the band for engagement under a rim on the container on fitting of the cap to the container;

invert V fold members between and interconnecting the tongues;

ribs on the radially outer surfaces of the tongues for limiting the radial movement of tongues on fitting of the cap to the container, and a ridge on the inside surface of the skirt for co-operating with the ribs in limiting radial movement of the tongues.

8. A plastics material cap as claimed in claim 4, wherein the skirt has an anti-tamper band.

9. A plastics material cap as claimed in claim 8, wherein the anti-tamper band comprises:

a plurality of upwardly directed tongues resiliently mounted on the band for engagement under a rim on the container on fitting of the cap to the container, invert V fold members between and interconnecting the tongues;

ribs on the radially outer surfaces of the tongues for limiting the radial movement of tongues on fitting of the cap to the container; and a ridge on the inside surface of the skirt for co-operating with the ribs in limiting radial movement of the tongues.

10. A plastics material cap for closing a container, the cap comprising:

a top and a skirt, means integrally formed with the top on its inside for sealing the cap to the container;

means on the skirt for holding the cap in sealing relationship with the container; and an anti-tamper band frangibly connected to the skirt, the band having a plurality of upwardly directed tongues resiliently mounted on the band for engagement under a rim on the container on fitting of the cap to the container wherein there are also provided:

invert V fold members between and interconnecting the tongues;

ribs on the radially outer surfaces of the tongues for limiting the radial movement of tongues on fitting of the cap to the container; and a ridge on the inside surface of the skirt for co-operating with the ribs in limiting radial movement of the tongues.

11. A plastics material cap as claimed claim 10, wherein the cap holding means is a screw thread in the skirt for threadedly engaging a complementary thread on the container.

12. A plastics material as claimed in claim 11, wherein there is provided:

a first annular sealing member arranged to abut the inside of a neck of the container and a second annular sealing member arranged to abut the distal end of the neck of the container, the first and second members have a common root, whereby abutment of the distal end of the container with the second member tends to rotate the first member into firmer contact with the inside of the neck, a third annular sealing member arranged to abut the outside of the neck of the container; and wherein:

the three annular sealing members depend from the top of the cap;

the three annular sealing members are lips dimensioned for slight deflection on sealing abutment with the container and adapted to deflect against the bottle under pressure of fluid to be sealed, the first sealing lip extending transversely of the top of the cap from the common root, the second sealing lip extending obliquely towards the skirt of the cap from the common root and the third sealing lip extending transversely of the top of the cap, and the sealing lips are of substantially the same cross-sectional shape, being in cross-section:
substantially uniform thickness lips, with
rounded sealing edges.

13. A plastics material as claimed in claim 10, wherein there is provided:

a first annular sealing member arranged to abut the inside of a neck of the container and a second annular sealing member arranged to abut the distal end of the neck of the container, the first and second members have a common root, whereby abutment of the distal end of the container with the second member tends to rotate the first member into firmer contact with the inside of the neck, a third annular sealing member arranged to abut the outside of the neck of the container; and wherein:

the three annular sealing members depend from the top of the cap;

the three annular sealing members are lips dimensioned for slight deflection on sealing abutment with the container and adapted to deflect against the bottle under pressure of fluid to be sealed, the first sealing lip extending transversely of the top of the cap from the common root, the second sealing lip extending obliquely towards the skirt of the cap from the common root and the third sealing lip extending transversely of the top of the cap, and the sealing lips are of substantially the same cross-sectional shape, being in cross-section:
substantially uniform thickness lips, with
rounded sealing edges.

* * * * *